US011390999B2

(12) United States Patent
Sterner et al.

(10) Patent No.: US 11,390,999 B2
(45) Date of Patent: Jul. 19, 2022

(54) METHOD AND APPARATUS FOR PRODUCING A WEB OF EXTENSIBLE FIBROUS MATERIAL

(71) Applicant: Giorgio Trani, Venice (IT)

(72) Inventors: Marion Sterner, Venice (IT); Federico Cariolaro, Vicenza (IT)

( * ) Notice: Subject to any disclaimer, the term of this patent is extended or adjusted under 35 U.S.C. 154(b) by 104 days.

(21) Appl. No.: 16/487,228

(22) PCT Filed: Feb. 22, 2018

(86) PCT No.: PCT/IB2018/051094

§ 371 (c)(1),
(2) Date: Aug. 20, 2019

(87) PCT Pub. No.: WO2018/154474

PCT Pub. Date: Aug. 30, 2018

(65) Prior Publication Data

US 2021/0040694 A1 Feb. 11, 2021

(30) Foreign Application Priority Data

Feb. 22, 2017 (IT) ..... 102017000019934

(51) Int. Cl.
*D21H 25/00* (2006.01)
*B31F 1/18* (2006.01)

(52) U.S. Cl.
CPC ..... *D21H 25/005* (2013.01); *B31F 1/18* (2013.01)

(58) Field of Classification Search
CPC ..... D21H 25/005; D21H 5/245; D21H 5/24; D21H 23/58; D21H 25/12; D21H 27/00; B29C 2043/463; D21F 11/006; B31F 1/18; B31F 1/128; B31F 1/22; D06C 15/06

See application file for complete search history.

(56) References Cited

U.S. PATENT DOCUMENTS 2,624,245 A * 1/1953 Cluett ..... D21H 25/005 162/206
3,290,209 A * 12/1966 Ihrman ..... D21H 5/245 162/361
3,471,357 A * 10/1969 Bildusas ..... D21H 19/82 428/336

(Continued)

FOREIGN PATENT DOCUMENTS

GB 1197225 7/1970
WO WO-2018154474 A1 * 8/2018 ..... B31F 1/18

*Primary Examiner* — Jose A Fortuna
(74) *Attorney, Agent, or Firm* — Themis Law

(57) ABSTRACT

A method of producing a web of extensible fibrous material includes passing a web of fibrous material between a cylinder of rigid material having, on the side surface, a plurality of incisions running circumferentially, and a web having an outer layer of elastically compressible material kept locally pressed, at a pressing area, against the side surface of the cylinder, the cylinder and the web being configured and arranged so that the web adheres to the cylinder over a portion located downstream of the pressing area, the web has a portion downstream of the pressing area with a concavity substantially opposite to that of a portion of the web upstream of the pressing area, and the peripheral speeds of the cylinder and the web in the pressing area are substantially equal.

21 Claims, 1 Drawing Sheet

(56) References Cited

U.S. PATENT DOCUMENTS

Figure 1:
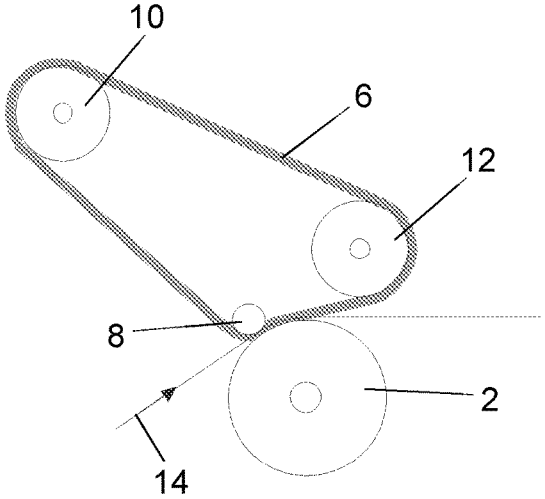

| | | | | | |
|---|---|---|---|---|---|
| 3,515,633 | A * | 6/1970 | Futch, Jr. | D21H 5/245 | 162/206 |
| 3,556,921 | A * | 1/1971 | Painter et al. | D04H 1/00 | 428/181 |
| 4,588,475 | A * | 5/1986 | Lundstrom | D21F 3/02 | 162/205 |
| 4,834,838 | A * | 5/1989 | Klowak | C09J 7/04 | 162/109 |
| 6,458,447 | B1 * | 10/2002 | Cabell | D21F 11/006 | 428/167 |
| 7,918,966 | B2 * | 4/2011 | Trani | D21F 11/02 | 162/203 |
| 8,282,779 | B2 * | 10/2012 | Trani | B31F 1/18 | 162/361 |
| 8,544,156 | B2 * | 10/2013 | Morris | F16C 13/00 | 26/18.6 |
| 8,603,299 | B2 * | 12/2013 | Trani | B31F 1/18 | 162/361 |
| 10,017,900 | B2 * | 7/2018 | Trani | D21G 1/0293 | |
| 10,724,178 | B2 * | 7/2020 | Trani | B29C 53/005 | |
| 2010/0326612 | A1 * | 12/2010 | Hupp | D21H 27/002 | 162/109 |
| 2013/0037231 | A1 * | 2/2013 | Trani | B31F 1/18 | 162/217 |
| 2016/0138222 | A1 * | 5/2016 | Trani | B29C 53/005 | 264/175 |
| 2018/0038049 | A1 * | 2/2018 | Trani | D21G 1/0086 | |
| 2018/0291558 | A1 * | 10/2018 | Trani | D21H 23/58 | |
| 2020/0354893 | A1 * | 11/2020 | Trani | B29C 53/005 | |
| 2021/0040694 | A1 * | 2/2021 | Sterner | D21H 25/005 | |
| 2021/0070006 | A1 * | 3/2021 | Sterner | D21H 25/005 | |

* cited by examiner

METHOD AND APPARATUS FOR PRODUCING A WEB OF EXTENSIBLE FIBROUS MATERIAL

FIELD OF THE INVENTION

The present invention relates to a method and apparatus for producing a web of extensible fibrous material.

BACKGROUND OF THE INVENTION

Methods and apparatuses for producing webs of extensible paper are known. U.S. Pat. Nos. 2,624,245 and 3,515,633 show how to manufacture one of these webs with an apparatus comprising a heated rotating cylinder provided with a smooth side surface, and a blanket consisting of a rubber web adhered, by means of at least partially motorized return rollers, to the surface of the heated cylinder and fed at the same peripheral speed thereof.

In order to reduce the friction between the blanket and the smooth side surface of the heated cylinder, water or a mixture of water and silicone may be sprayed therebetween.

The arrangement of the blanket on the side surface of the heated cylinder and of the return rollers is such that a portion of the blanket is pressed by a roller or by a fixed return bar against the surface of the cylinder, and at that area the blanket, which before coming into contact with the cylinder had a concavity facing the opposite part of the cylinder, changes concavity and faces it.

The combined effect of change in concavity and removal of the web from the pressure roller, which presses it against the cylinder, determines a longitudinal compaction of the fibers of a paper web passed between the blanket and the cylinder, resulting in the transfer of good longitudinal extensibility features to the web itself, and in particular making it extensible up to about 15%.

However, this extensibility is only in the longitudinal direction (machine direction) but not in the transverse direction, apart from the natural extensibility which any paper sheet has. As a result, the webs obtained by means of this known process cannot be used in all those cases in which an extensible paper is also required in the transverse direction.

EP 824618B1 and EP 3024977A1 describe methods and apparatuses for manufacturing paper webs which are extensible in all directions. Such methods proved to be valid from the point of view of obtainable results, while however showing a certain implementation and management complexity, which limited the diffusion thereof.

U.S. Pat. No. 3,290,209 describes a piece of equipment for producing extensible paper by passing a fibrous web between a hard roller of metal material and an endless web of elastic material which is wound about respective return rollers. The hard roller of metal material, the surface of which is affected by incisions, rotates at a speed which is 6-15% faster than that of the web of elastic material. The function of the incisions is to eliminate the contact friction of the fibrous web with the metal roller, and in this regard, the web of elastic material shall have a hardness such as to allow the fibrous web to slide between the ridges of the incisions of the hard roller of metal material, thus avoiding the web itself from completely entering into said incisions since this would increase the contact friction. Furthermore, in this apparatus the fibrous web is fed so that the fibrous web portion upstream of the pressing area, defined by the pressure of the web of elastic material on the hard roller, is substantially rectilinear (i.e., free of concavity) and coplanar with respect to said pressing area. Last but not least, the exiting fibrous web is extensible only in the longitudinal direction (i.e., in the machine direction).

SUMMARY OF THE INVENTION

It is the object of the invention to suggest a process and/or apparatus to overcome the drawbacks of conventional solutions.

It is another object of the invention to suggest a process which allows to provide, in a simple form and with equipment of easy and economical construction and management, systems adapted to produce paper webs, and in general fibrous material webs, combining the advantages of a high extensibility in each direction with the merits of a low production cost.

It is another object of the invention to suggest a process and/or apparatus which may be implemented in a simple manner and with low costs.

It is another object of the invention to suggest a process and/or apparatus having an alternative and/or improved characterization, both in terms of construction and function, as compared to conventional solutions.

All these objects, considered individually or in any combination thereof, as well as others which will result from the following description, are achieved, according to the invention, by a method for producing webs of fibrous material extensible in all directions, and by an apparatus as described herein.

BRIEF DESCRIPTION OF THE INVENTION

Figure 2:
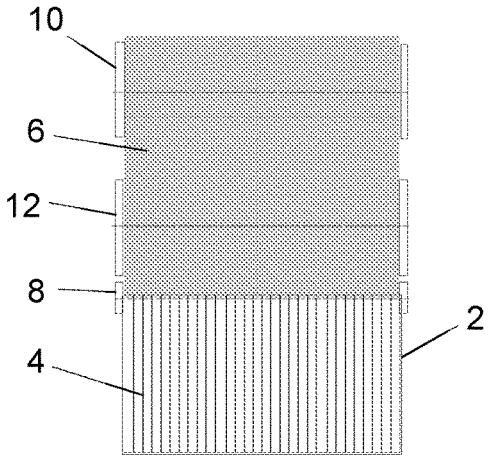
Figure 3:
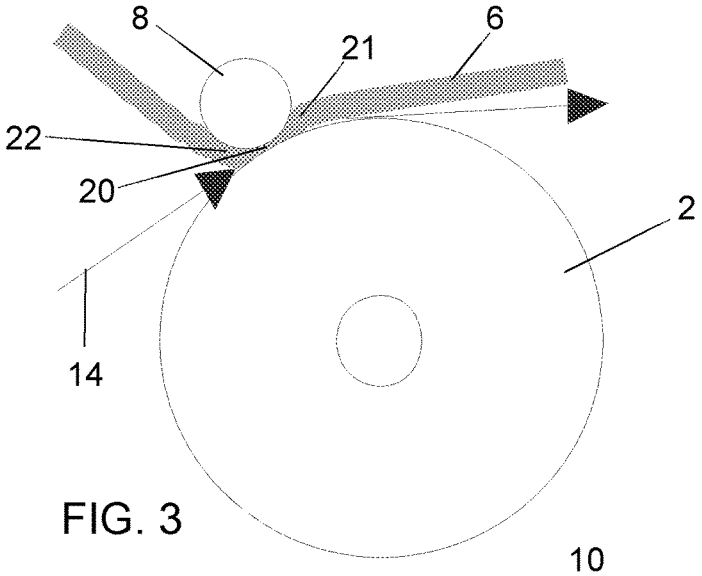
Figure 4:
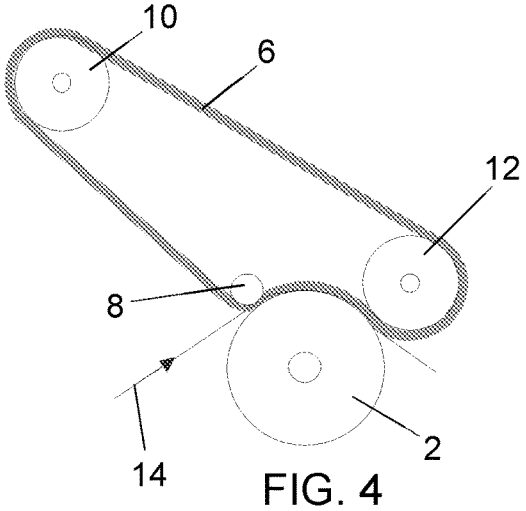
Figure 5:
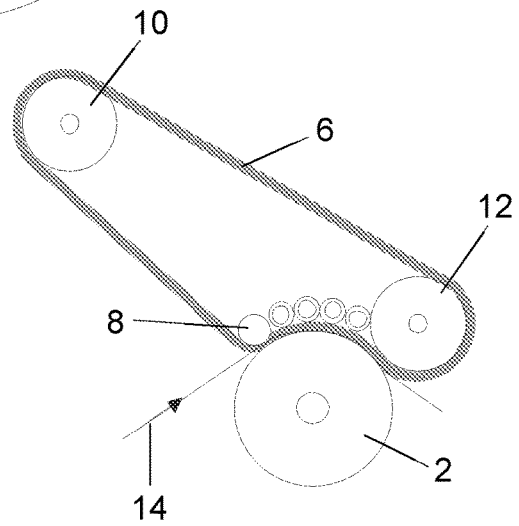

The present invention is further clarified below in some of the preferred embodiments thereof, given merely by way of explanation and not by way of limitation, with reference to the accompanying drawings, in which:

FIG. 1 shows a diagrammatic side view of an apparatus to implement the method according to the invention, FIG. 2 shows the apparatus according to the front view II-II in FIG. 1, FIG. 3 shows an enlarged detail in FIG. 2, FIG. 4 shows the same view in FIG. 1 of the apparatus in a second embodiment, and FIG. 5 shows the same view in FIG. 1 of the apparatus in a third embodiment.

DETAILED DESCRIPTION OF EMBODIMENTS OF THE INVENTION

As shown in the figures, the apparatus according to the invention comprises a cylinder 2 of rigid material, preferably made of metal and/or motorized.

Advantageously, the metal cylinder 2 may be entirely made of metal (e.g. steel or cast iron), or possibly of metal (e.g. steel or cast iron) coated in the side surface with a layer of different material, e.g. ceramic, having different features and mechanical properties.

The side surface of the cylinder 2 is affected by a plurality of incisions 4.

Conveniently, the incisions 4 may be in hollow or raised. Conveniently, the incisions 4 may develop in the circumferential direction or even with a different pattern, but with a circumferential component, and may be continuous or discontinuous, completely separate from one another or even intersecting one another.

Advantageously, the incisions 4 are such as to make the side surface of the cylinder 2 micro-scratched.

Conveniently, at the side surface of the cylinder 2, the incisions 4 define along the development direction of the rotation axis of the cylinder itself (i.e. in the transverse direction) hollow portions delimited by a curved profile having a concavity facing the exterior of the cylinder 2.

Conveniently, the incisions 4 are (transversely) placed side-by-side. Advantageously, between the laterally/transversely adjacent incisions 4 (i.e., in the development direction of the rotation axis of the cylinder 2), straight portions or curved portions are provided, having a concavity facing the interior of the cylinder 2.

Conveniently, the incisions 4 may have a depth substantially from 0.01 mm to 2 mm, preferably from about 0.05 mm to 0.5 mm.

Conveniently, the incisions 4 may have a width substantially from 0.01 mm to 2 mm, preferably from about 0.05 mm to 0.09 mm.

Conveniently, the incisions 4 may have a pitch substantially from 0.01 to 10 mm.

Conveniently, in the case of spiral-shaped incisions 4, the angle of inclination of the spiral may be from a minimum value, allowed by the width of the incision, to a maximum value of 45°, even if it is preferable that it is from 5° to 15°; furthermore, it may be the same over the whole axial length of the cylinder 2 or it may be opposite for the two halves of the cylinder itself.

The apparatus according to the invention also comprises a preferably continuous web 6, with an outer layer of elastically compressible material.

Conveniently, the web 6 is mounted about at least one roller having a support and/or movement function. In particular, the web 6 is stretched between rollers 8, 10, 12, having the function of moving the web while keeping it with a portion thereof adhering to the cylinder 2.

Conveniently, the apparatus according to the invention comprises a pressing element which has the function of pressing/pushing the continuous web 6 against the cylinder 2 so as to locally reduce the thickness thereof, thus defining a pressing area 20. Advantageously, the pressing element may be rotating, such as the roller 8 for example, or may be fixed, such as a bar, for example.

Conveniently, the roller 10 may be motorized and the roller 12 may be an idle return roller. Advantageously, the position of the roller 12 with respect to the pressing element 8 determines the length of the portion of web 6 wound about the cylinder 2, i.e., the portion of web 6 which adheres to the latter. Conveniently, by varying the position of the roller 12 with respect to the pressing element 8, or vice versa, it is possible to vary the corresponding length of the portion of web 6 which adheres to the cylinder 2.

Advantageously, the web 6 consists of a rubber blanket having a thickness from 15 mm to 70 mm, preferably from 25 mm to 40 mm.

Advantageously, the web 6 consists of a rubber blanket having substantial longitudinal inextensibility at least on the side adhering to the return rollers 8, 10, 12. Conveniently, this inextensibility may be obtained, for example, by applying an inextensible sheet to the rubber web 6, or by incorporating longitudinal steel wires in the thickness of the rubber web 6.

Advantageously, the web 6 has a hardness from 70 to 240 PJ, preferably from 120 to 220 PJ.

The web 6 with an outer layer of an elastically compressible material is kept locally pressed, preferably by means of the pressing element 8, against the grooved side surface of the cylinder 2 at a pressing area 20.

Furthermore, the cylinder 2 and the web 6 are configured and arranged so that:

the web 6 also adheres to the cylinder 2 over a certain portion 21 located downstream of said pressing area 20, the web 6 has a portion 21 downstream of said pressing area 20 with a concavity substantially opposite to that of a portion 22 thereof upstream of the pressing area itself, in said pressing area 20 the peripheral speeds of the cylinder 2 and of the web 6 are substantially equal.

The operation of the apparatus described herein, which practically implements the method according to the invention, is as follows:

after the cylinder 2 and the web 6 are actuated, so that at the passage (i.e. at the pressing area 20) of the web itself between the cylinder 2 and the pressing element 8 they have the same peripheral speed, a web 14 of fibrous material is passed between them, so that it is dragged therebetween over the whole area of mutual contact thereof.

Conveniently, this fibrous material may consist of paper or vegetable and/or synthetic fibers, non-woven fabric, etc. Preferably, the entering fibrous material has a 40-95% degree of dryness, preferably 60-85% and even more preferably 63-75%.

As the web 14 of fibrous material moves between the elastically compressible material 6 and the cylinder 2, it is subjected to different effects.

A first effect is due to the abrupt change in concavity of the web 6 at the upstream portion 22 of the pressing area 20. In particular, such an abrupt change in concavity determines a longitudinal extension of the layers of the web 6 which are far from the cylinder 2, which thus pass from a concave area to a convex area, while determining a longitudinal compaction of the layers thereof close to the cylinder 2, passing from a convex area to a concave area. Therefore, this effect determines a longitudinal compaction of the web 14 of fibrous material, which tends to adhere to the surface of the web 6, which in this area is compacted, and to slide instead on the cylinder 2.

A second effect is due to the abrupt increase in thickness of the rubber web 6 when exiting from the passage between the pressing element 8 and the cylinder 2, and to the consequent decrease in speed in the portion 21 downstream of the pressing/tightening area 20. Moreover, since the magnitudes involved and the configuration of the apparatus are selected so that, in the pressing/tightening area 20, the peripheral speed of the surface of web 6 facing the cylinder 2 is equal to the peripheral speed of the cylinder 2, downstream of that tightening the peripheral speed of that surface of the web 6, and therefore of the web 14 of fibrous material which adheres thereto, will clearly undergo a braking, with a further effect of longitudinal compaction of the web 14 of fibrous material.

A third effect is due to the presence of the incisions 4 in the surface of the cylinder 2, which incisions, by virtue of the braking effect due to the web 6 onto the web 14 of fibrous material, in addition to determining a longitudinal compaction thereof, also cause it to accumulate inside the incisions 4, and thus to accumulate practically in the transverse direction of the web 14 of fibrous material.

The combination of these three effects thus leads to obtaining a web 14 of fibrous material compacted longitudinally and with an accumulation of material in the transverse direction, and thus to a fibrous material which is practically substantially extensible in each direction.

Since the entity of the transverse compaction of the web 14 of fibrous material is essentially related to the features of the incisions 4, by adjusting the shape, size and pitch thereof, it is possible to obtain a material having not only longitudinal, but also transverse extensibility, which is substantially greater than the entering web of fibrous material.

Advantageously, in the embodiment shown in FIG. 4, the return roller 12 is arranged so as to prolong the portion of web 6—which is positioned downstream of the pressing area defined between the web itself and the pressing element—which is in contact with and adheres to the cylinder 2, thus prolonging the longitudinal compaction effect of the web 14 due to the difference in length between the two surfaces of the web 6 in the portion in which it winds the cylinder 2.

Advantageously, in the embodiment shown in FIG. 5, the portion of web 6 wound about the cylinder 2 is affected by a plurality of pressing elements. Preferably, the plurality of pressing elements has a graduated pressing effect, so as to obtain a change in speed of the web 6 in the winding portion, which speed change is graduated in the whole portion, instead of being concentrated on the initial portion thereof.

Conveniently, irrespective of the embodiment adopted, the pressing element 8 may be, as said, a roller or a non-rotating bar, of the simplest construction; in this case, the inevitable friction between this and the web 6 may be attenuated if a lubricating and/or wetting liquid, such as water or a mixture of water and silicone, for example. is sprayed therebetween.

From the above description, it is apparent that the method according to the invention and the apparatus for implementing it are considerably advantageous as compared to the prior art, and in particular allow obtaining fibrous materials extensible in each direction by means of a very simple apparatus with a safe and reliable operation. It may be inserted into an in-line system for the production of paper, for example, and in this case it may be fed with a layer of cellulose fiber mixture, which will form the web; or it may form a stand-alone machine, which is fed with a paper web already formed and previously subjected to wetting, so that the dry content thereof is brought to a value from 40% to 95%, preferably from 60% to 85%.

The invention claimed is:

1. A method of treating a web of extensible fibrous material to increase extensibility in multiple directions, comprising:

passing a web of the extensible fibrous material through a passage between a cylinder of rigid material having, on a side surface, a plurality of incisions running circumferentially, and a pressing web having an outer layer of elastically compressible material kept locally pressed, at a pressing area, against the side surface of said cylinder, said pressing web being longitudinally inextensible at least on a side that is not facing said cylinder, peripheral speeds of said cylinder and of said pressing web in said pressing area being substantially equal;

pressing the web of the extensible fibrous material to cause the extensible fibrous material to accumulate inside the incisions; and causing said pressing web to adhere to said cylinder over a portion located downstream of said pressing area, said pressing web assuming, downstream of said pressing area, a concavity opposite to a concavity assumed by said pressing web upstream of said pressing area.

2. The method according to claim 1, wherein, when exiting the passage between said cylinder and said pressing web, the web of the extensible fibrous material is extensible both longitudinally and transversally.

3. The method according to claim 1, wherein said incisions are transversely placed side-by-side and define hollow portions on the side surface delimited by a curved profile having a concavity towards an exterior of said cylinder.

4. The method according to claim 3, wherein, between said incisions transversely placed side-by-side, straight portions or curved portions are provided, having a concavity towards an interior of the cylinder.

5. The method according to claim 1, wherein the incisions have a depth from 0.01 mm to 2 mm.

6. The method according to claim 1, wherein the incisions have a width from 0.01 mm to 2 mm.

7. The method according to claim 1, wherein the incisions have a pitch from 0.01 to 10 mm.

8. The method according to claim 1, wherein said incisions are spiral-shaped.

9. The method according to claim 1, wherein an elastic return of said pressing web is progressively decreased in a controlled manner over at least part of the portion in which the pressing web adheres to said cylinder downstream of said pressing area.

10. The method according to claim 1, wherein said pressing web having the outer layer of elastically compressible material is continuous and is mounted about at least one element having a support and/or movement function.

11. The method according to claim 10, wherein said pressing web has longitudinal inextensibility at least on a side adhering to the at least one element provided for supporting and moving the at least one element.

12. The method according to claim 1, wherein said pressing web having the outer layer of elastically compressible material is continuous and is mounted about at least two rollers arranged and configured so that said pressing web has said portion which adheres to the cylinder.

13. The method according to claim 1, wherein said pressing web having the outer layer of elastically compressible material is passed between said cylinder and a pressing element, which keeps said pressing web locally pressed against said cylinder.

14. The method according to claim 1, further comprising the step of providing at least one pressing element adapted to press or push said pressing web against the cylinder so as to locally reduce a thickness of the pressing web and thus define said pressing area.

15. The method according to claim 14, wherein said pressing element is fixed.

16. The method according to claim 14, wherein there is provided a plurality of pressing elements adapted to press or push said pressing web against the cylinder so as to locally reduce the thickness of the pressing web.

17. The method according to claim 16, wherein said plurality of pressing elements is disposed to provide a graduated pressing effect.

18. The method according to claim 14, further comprising the step of spraying a lubricating liquid between said at least one pressing element and said pressing web.

19. The method according to claim 14, wherein said pressing web is mounted about said pressing element and about a support element, and wherein, by varying a distance between said pressing element and said support element, a length of the portion of pressing web which adheres to the cylinder is varied.

20. An apparatus for implementing a method according to claim 1, comprising:

a cylinder having, on a side surface thereof, a plurality of incisions running circumferentially;

a pressing web with an outer layer of elastically compressible material which is kept over a portion in contact with the side surface of said cylinder, said pressing web being longitudinally inextensible at least on a side that is not facing said cylinder;

at least one pressing element arranged and configured so as to locally press said pressing web against said cylinder in at least one part of a mutual contact area, where said pressing web adheres to said cylinder, and so as to further cause a change in a concavity of said pressing web in a passage from an upstream portion of said pressing area to a downstream portion of the pressing area, and a system that moves said cylinder and said pressing web so that peripheral speeds of said cylinder and said pressing web at said pressing area are equal, wherein the cylinder and the pressing web are arranged to cause the pressing web to assume opposing concavities before and after the mutual contact area.

21. The apparatus according to claim 20, wherein the elastically compressible material has a hardness higher than 125 PJ.

* * * * *